US005483773A

United States Patent [19]

Parisien

[11] Patent Number: 5,483,773

[45] Date of Patent: Jan. 16, 1996

[54] PREFABRICATED BALCONY

[75] Inventor: Harvey E. Parisien, Kingston, Canada

[73] Assignee: Alcuf Inc., Kingston, Canada

[21] Appl. No.: 243,692

[22] Filed: May 17, 1994

[30] Foreign Application Priority Data

May 28, 1993 [CA] Canada ..... 2097213

[51] Int. Cl.[6] ..... E04B 1/00

[52] U.S. Cl. ..... 52/73; 52/79.6; 52/299; 52/650.3; 52/656.1; 52/731.4

[58] Field of Search ..... 52/73, 690, 731.4, 52/731.7, 731.8, 732.3, 656.1, 650.3, 263, 236.6, 169.9, 299, 732.1, 731.2, 731.1, 79.6

[56] References Cited

U.S. PATENT DOCUMENTS

| | | | |
|---|---|---|---|
| 2,235,761 | 3/1941 | Goldsmith | 52/656.1 X |
| 2,692,033 | 10/1954 | Jaynes | 52/73 |
| 2,985,263 | 5/1961 | Maciunas | 52/731.2 X |
| 3,084,479 | 4/1963 | Struben | 52/73 X |
| 3,143,827 | 8/1964 | Showalter, Sr. | 52/263 X |
| 3,216,170 | 11/1965 | Deadrick | 52/732.1 |
| 3,751,870 | 8/1973 | Vesei | 52/656.1 |
| 3,778,175 | 12/1973 | Zimmer | 52/645 X |
| 3,823,520 | 7/1974 | Ohta | 52/73 |
| 3,867,802 | 2/1975 | Murphy | 52/731.2 X |
| 3,875,707 | 4/1975 | Horn | 52/263 X |
| 3,875,712 | 4/1975 | Thompson | 52/263 |
| 3,879,017 | 4/1975 | Maxcy et al. | 256/65 |
| 3,948,008 | 4/1976 | Goetz | 52/73 |
| 4,100,703 | 7/1978 | Sickler | 52/73 X |
| 4,272,073 | 6/1981 | Grosser et al. | 52/732.1 X |
| 4,548,003 | 10/1985 | Johansson et al. | 52/73 |
| 4,624,091 | 11/1986 | Biro | 52/732.1 X |
| 4,660,799 | 4/1987 | Butland | 52/650.3 X |
| 4,667,450 | 5/1987 | Stefnik | 52/656.1 X |
| 4,785,591 | 11/1988 | Dehlen | 52/73 |
| 4,796,391 | 1/1989 | Lu | 52/73 |

FOREIGN PATENT DOCUMENTS

| | | | |
|---|---|---|---|
| 1464678 | 11/1966 | France | 52/731.7 |
| 2690186 | 10/1993 | France | 52/73 |
| 2553117 | 8/1976 | Germany | 52/73 |
| 2547897 | 5/1977 | Germany | 52/731.2 |
| 5-44249 | 2/1993 | Japan | 52/73 |
| 5-230867 | 9/1993 | Japan | 52/73 |
| 569161 | 11/1975 | Switzerland | 52/263 |
| 226911 | 1/1925 | United Kingdom | 52/731.2 |
| 2044829 | 10/1980 | United Kingdom | 52/731.2 |
| 2072731 | 10/1981 | United Kingdom | 52/747 |

*Primary Examiner*—Carl D. Friedman
*Assistant Examiner*—Laura A. Saladino
*Attorney, Agent, or Firm*—Robert G. Hendry; Robert A. Wilkes

[57] ABSTRACT

A structure assembled of aluminum alloy extrusion and sheathing such as composite particle board for use as porches, balconies, or the like. The parts include posts, a frame having corner fasteners, and channel type beams supported by the frame and secured to the frame by fasteners in a manner requiring a minimum of on-site drilling of holes in the aluminum alloy parts.

5 Claims, 5 Drawing Sheets

PREFABRICATED BALCONY

BACKGROUND OF THE INVENTION

The present invention relates to prefabricated metal structural units and more particularly to framework for balconies, porches and the like. It is known to construct balconies on concrete buildings by the floor slab, and using poured in place concrete to provide a cantilevered balcony slab. However, balconies for frame buildings are typically wood structures supported by posts. Alternatively, the balcony may be constructed of steel structural elements usually welded together on site.

Wood and steel construction require expensive on-site labour and may require considerable maintenance particularly painting to prevent rot in the case of wood structures and to prevent rust in the case of the steel structures. Steel structural elements while being more durable are heavy and require lifting machinery and more elaborate safety precautions. Wood structures of this type decrease in strength during useful life due to weathering and decay.

OBJECTS OF THE INVENTION

In view of the above, it is the aim of this invention to achieve the following results.

To provide a balcony structure for use on a frame building which requires minimum of scaffolding during construction.

To provide a substantially fire resistant deck having the advantages of a concrete slab while reducing the weight of the deck to that comparable with wood.

To reduce on-site labour by using fastening means and bolts requiring fewer holes to be drilled.

To use light extruded members of prepainted aluminum alloys requiring minimum maintenance, and capable of being easily manhandled into position.

To increase the strength of the structure by providing improved shapes and connecting means to reduce the number of holes required for fastening structural members together.

SUMMARY OF THE INVENTION

Accordingly, the present invention provides a metal structure, at least a pair of tubular posts for supporting a frame including frame members each comprising a C shaped cross-section, a slot to receive a corner key, a flange extending horizontally to support cross-members, and deck material and a vertically depending flange secured to the tubular posts.

DESCRIPTION OF THE DRAWINGS

In the drawings which illustrate preferred embodiments of the drawings.

DETAILED DESCRIPTION OF THE INVENTION

Figure 1:
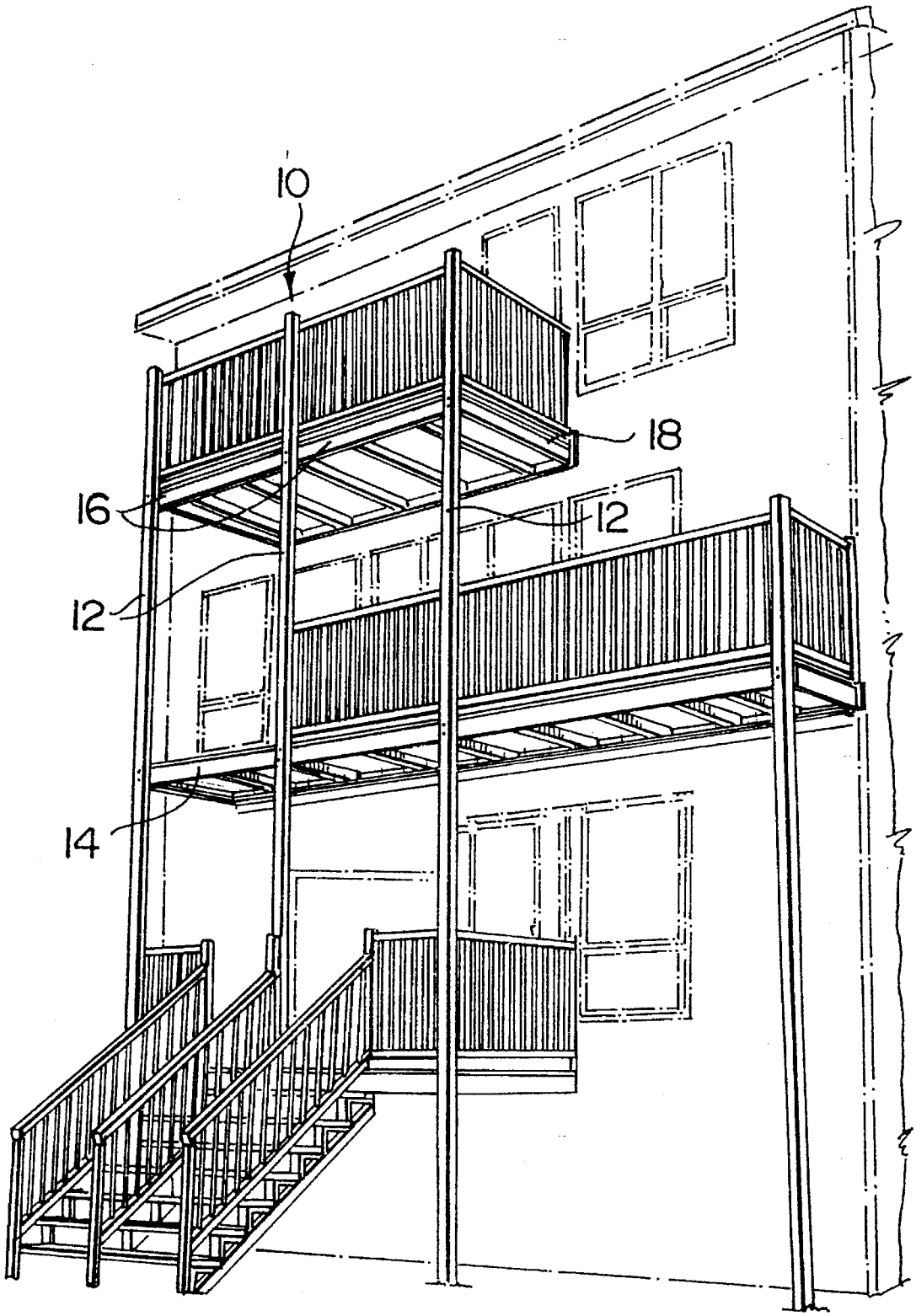
FIG. 1 is a perspective view of a balcony structure in accordance with this invention.
Figure 2:
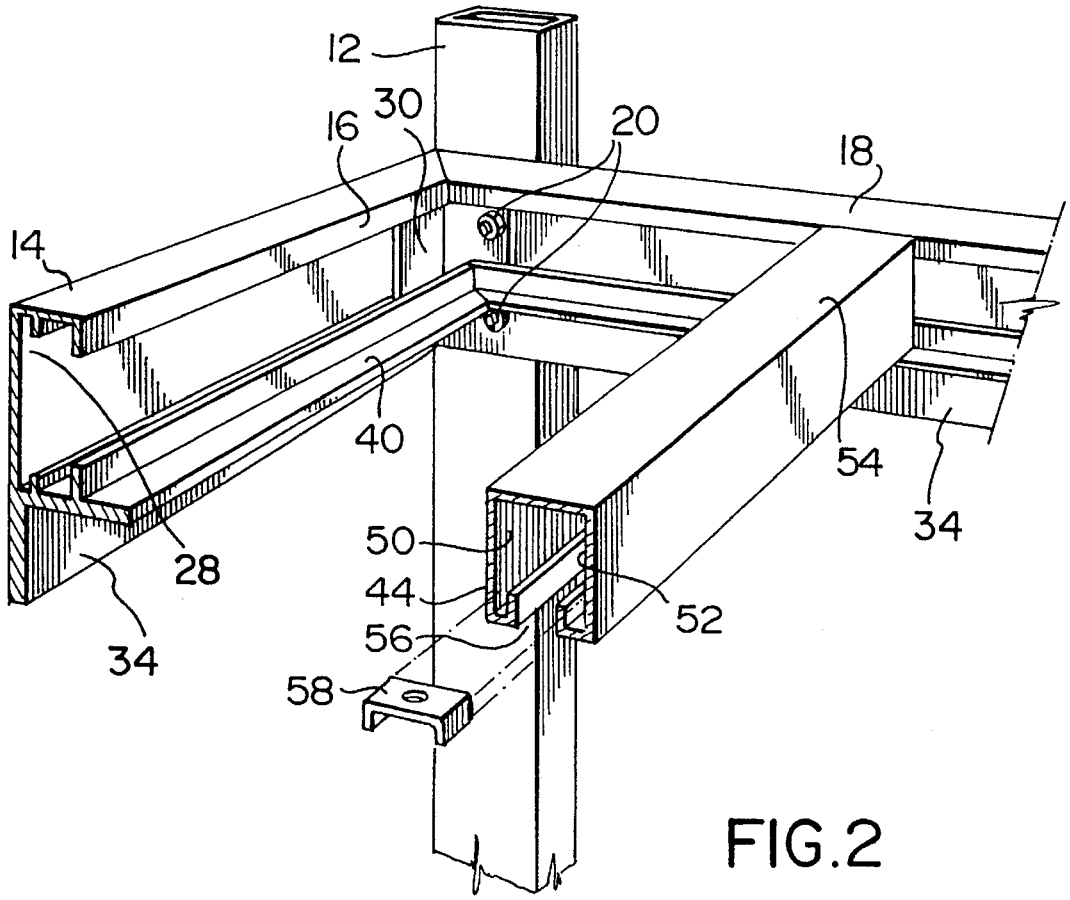
FIG. 2 is a perspective view of frame members secured to a post to provide the balcony construction of FIG. 1.

Referring now in detail to the drawings, the balcony structure shown generally at 10 in FIG. 1 includes posts 12 supporting a frame 14. As shown in FIG. 2 the posts 12 are square, tubular extruded members fabricated of corrosion resistant light metal alloy such as aluminum alloy. In this embodiment frame members 16 and 18 (two of which are shown) are secured to the posts 12 as by bolts 20. Lag bolts (not shown) are preferably used to secure the frame 14 to a wall of a building. This frame 14 can also be supported by four posts 12 in addition to being fastened to the building by lag screws or the like.

Figure 2A:
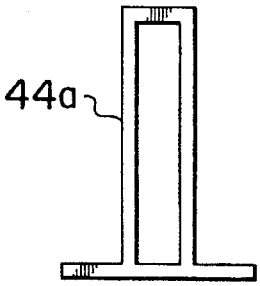
FIG. 2A is an end view of an alternate cross member.
Figure 2B:
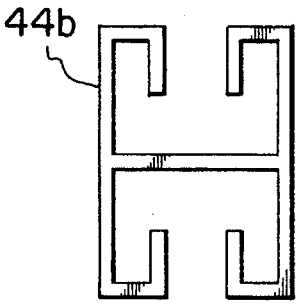
FIG. 2B is an end view of an alternative cross member.
Figure 3:
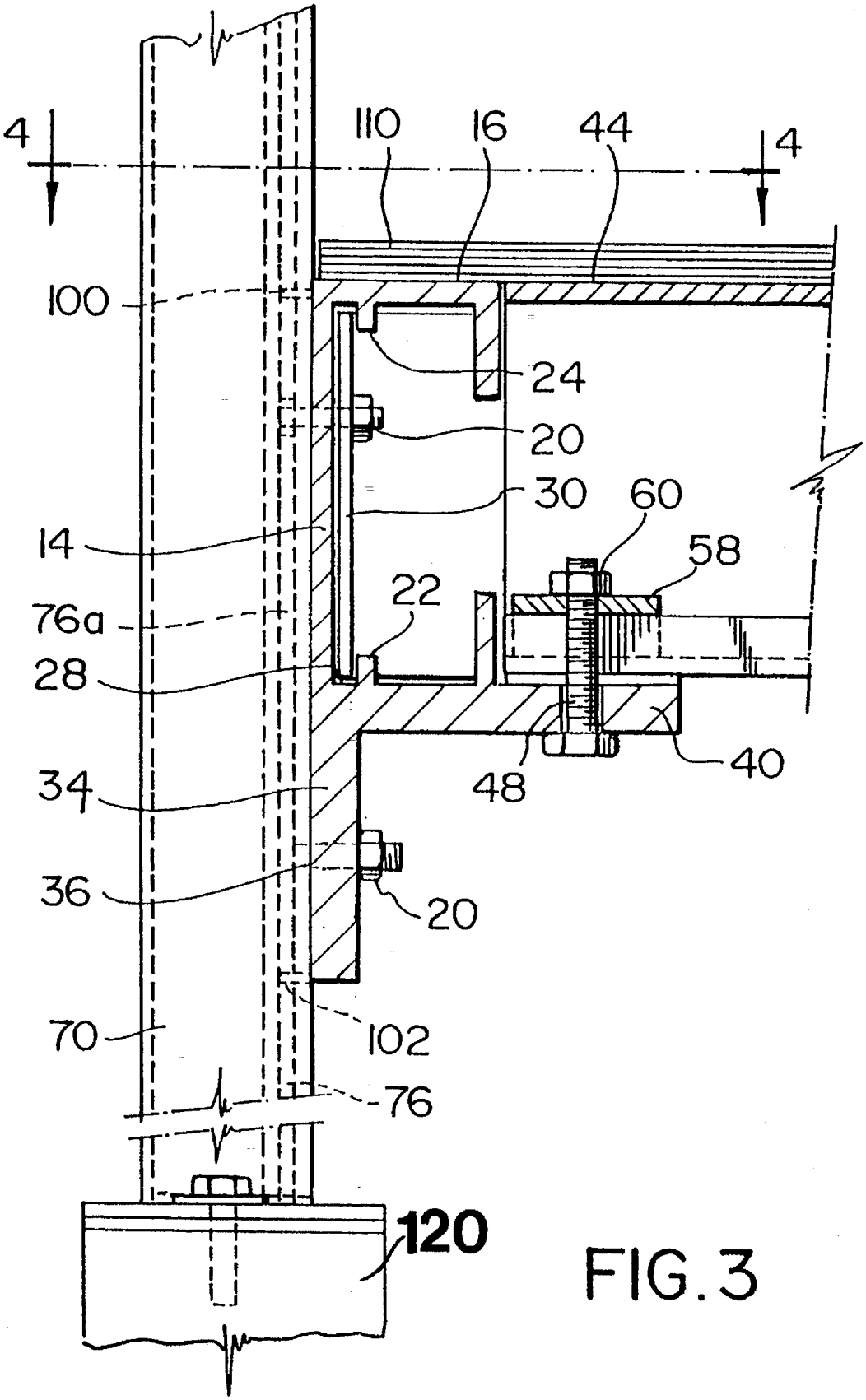
FIG. 3 is a side elevational view partly in section of the post, the frame members and beams secured thereto.

Each of the frame members 16 and 18 has a C shaped cross section and internal ribs 22 and 24 to define a slot 28 to receive a corner key 30 as shown in FIG. 3. A depending vertical flange 34 has suitable apertures 36 to receive securing means such as bolts 20 and additional bolts 20 extend through the corner key 30 and the post 12. The frame member 16 has a horizontal flange 40 to support cross-member 44 as shown in FIGS. 2 and 3. The cross-members 44 are channel type extruded metal beams having side walls 50, 52 and an interconnecting wall 54 the side walls being bent inwardly to define a restricted channel 56. A channel washer 58 received in the channel 56 has a bolt 60 extending therethrough fastening the cross member 44 to the horizontal flange 40 which has an aperture provided for this purpose as shown in FIGS. 2*a* and 2*b*. Cross members 44*a* also receive channel washer 58 whereas cross members 44*b* are attached to the frame 14 by suitable bolts or screws (not shown).

Figure 4:
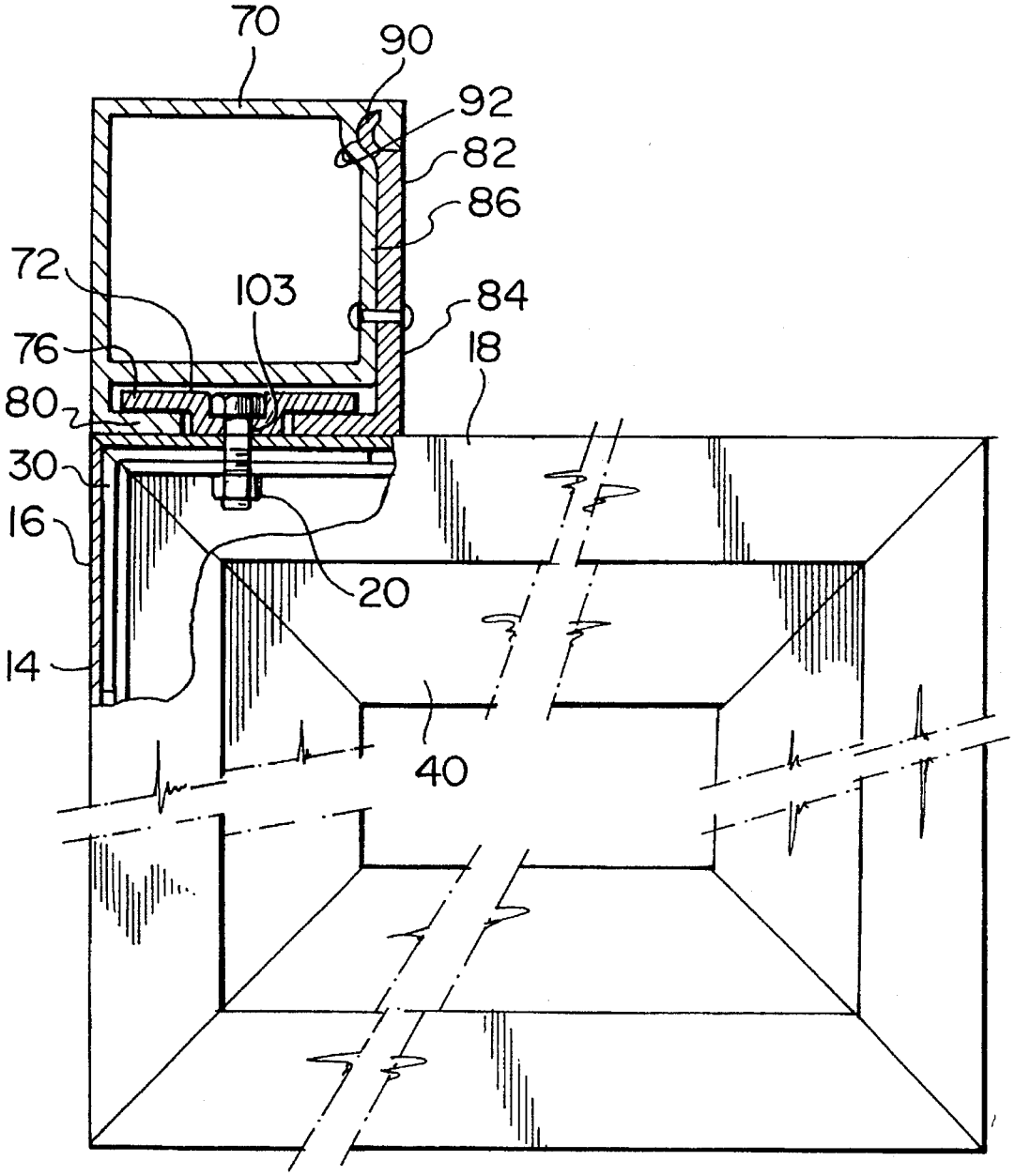
FIG. 4 is a cross section of the post taken along the line 4—4 of FIG. 3.

It will be noted that modified post 70 is used in the balcony system shown in FIGS. 3 and 4. The extruded post 70 differs from the post 12 described with reference to FIG. 2 in that a longitudinally extending keyway 72 is provided on one wall of the post 70. An extruded key or strip 76 is provided in the keyway 72 as shown more clearly in FIG. 4. A wall 80 of the keyway is integral with the post 70 whereas a second wall portion 82 of keyway 72 is formed by a right angle member 84 extending along a side wall. The member 84 is conveniently secured to the post 70 by forming a tongue 90 at its end adapted to be received in a groove 92 in the side wall 86.

As shown in FIG. 3 the extruded strip or key 76 is conveniently cut at 100 and 102 so that the portion of the strip indicated at 76*a* may be conveniently pre-drilled and inserted in the keyway 72. It will be appreciated that the extruded strip is a load bearing wall of the post 70 and that bolts do not pass through the post 70 as described in connection with the post 12 of FIG. 2. The bolts 20 shown in FIGS. 3 and 4 extend through holes 103 in the extruded strip 76 and the frame member 16, conventional retaining nuts are secured to the strip 162 in a conventional manner so as to be received on the bolts 20. The posts 12 and 70 are mounted on concrete bases one of which is shown at 120 in FIG. 3.

The material used for the floor 110 is preferably fire and weather resistant. Plywood covered with fibreglass reinforced plastic is an example of a suitable material. Other materials could include panels of wood fibre and portland cement composition, or wood polymer composite sold under the trade mark *Timbrex.

Figure 5:
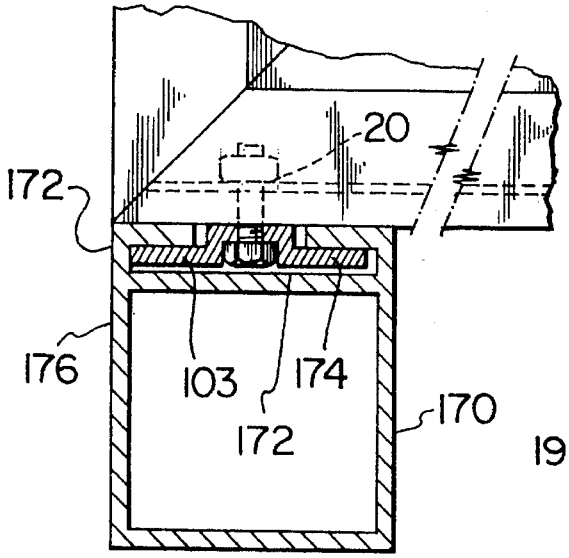
FIG. 5 is a cross section of an alternative construction of the post of FIG. 4.

A modified post 170 is shown in FIG. 5 for use in the balcony system of FIGS. 3 and 4 and differs from the post 70 in that a longitudinally extending keyway 172 is provided in the wall 176 of the post and an extruded key or strip 174 is adapted to slide into the keyway 172 from one end thereof. In this *TM embodiment a side of the keyway is not removable as is the case in the post 70.

Figure 6:
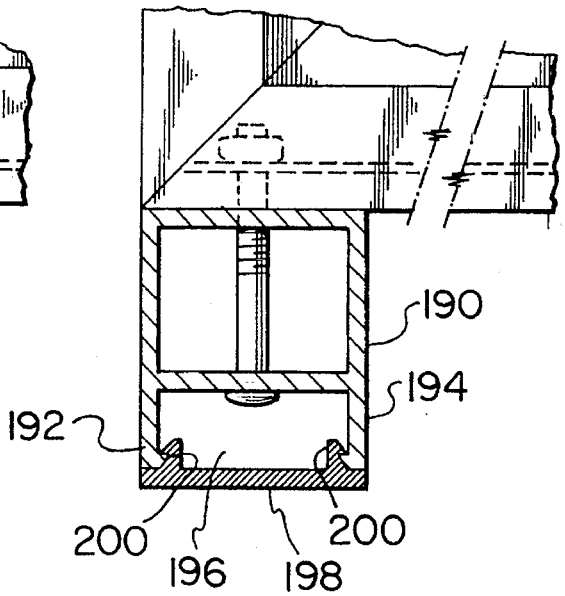
FIG. 6 is another construction of the post of FIG. 4.

A further modification of the post 12, shown at 190 in FIG. 6, has a pair of parallel walls 192 and 194 defining a channel having a mouth 196. Extruded cap 198 of suitable plastic material having barbed legs 200 to cooperate with outer ends of the walls 192 and 194 closes the channel mouth 196 after bolt 20 has been installed as described with reference to FIG. 2.

In use, the posts 12 or 70 are mounted on concrete bases 120 in a conventional manner. It is then possible to use posts 12 to support part of the scaffolding required to facilitate moving frame members 16 and 18 into place and securing frame members to posts using bolts 20 or keystrips 76 and bolts 20 described with reference to FIGS. 2, 3, and 4. The strip **76*a* is drilled and reinserted in the keyway 72 on site if desired. If a mistake is made calculating the location of the hole 103, the strip 76*a* is removed and replaced by a strip 76*a* having holes 103 in the required location. It is not necessary to replace the entire post 70**.

The frame member 16 and 18 have ends cut at 45° angles and the frame 14 is assembled by inserting corner keys 30 in slots 28. The corner keys 30 are conveniently held in place by bolts 20 or the like which pass through the keys 30 to attach the frame 14 to the posts 12 and 70 and a wall of a building.

Cross-members 44 are fastened to the frame 14 by channel washer 58 received in the channels 56 and bolts 60 extending through the channel washers 58 and the horizontal flange 40 of the frame 14.

I claim:

1. A metal structure, comprising at least a pair of tubular posts supporting a rectangular frame including frame members each comprising a C shaped cross section, each member having a top wall, a bottom wall, and an interconnecting wall defining a slot to receive a corner key, a corner key in said slot, and a horizontally extending flange extending from said bottom wall supporting cross members and deck material and a depending vertical flange on the interconnecting wall secured to said tubular posts wherein each of the cross members has a pair of side walls and an interconnecting wall whereby the outer edges of the side walls are bent inwardly to define a restricted channel and fastening means extends into the channel.

2. A metal structure as claimed in claim 1, wherein each said tubular posts has a keyway extending along one wall and a key strip in said keyway whereby fastening means extending through said key strip secure the posts to the frame member, and wherein a first portion of the keyway at one side of the post is integrally formed on the post wall and a second portion of the keyway is formed by a moveable right angle member having a tongue received in a groove in a side wall of the post.

3. In a balcony constructing including a frame secured to a wall and to tubular support posts for supporting flooring, each frame member of said frame comprising:

a top wall, a bottom wall and an interconnecting wall and a partial front wall defining a substantially C shaped cross section;

a downwardly directed rib on an inner face of said top wall and an upwardly directed rib on said bottom wall to define a keyway;

a horizontal flange extending from said bottom wall and a depending flange extending downwardly from said interconnecting wall adjacent ends of said frame members disposed at right angles thereby forming said frame, cross members are supported by said horizontal flanges for supporting the flooring and whereby the frame member and the depending flanges thereof are secured to the wall and to the tubular support posts.

4. In a metal structure including a frame secured to a wall and tubular support posts, and frame members and cross members on the frame for supporting floorings, each frame member of said frame comprising:

a top wall, a bottom wall, an interconnecting wall and a partial front wall defining a substantially C shaped cross section;

a downwardly directed rib on an inner face of said top wall and an upwardly directed rib on said bottom wall to define a keyway, and a horizontal flange extending from said bottom wall whereby corner keys received in said keyways join the adjacent-ends of said frame members disposed at right angles thereby forming said frame, the cross members are supported by said horizontal flanges for supporting the flooring and whereby the frame members are secured to said wall and to said tubular posts.

5. A metal structure as claimed in claim 4, wherein walls of each said support post extend outwardly to define a channel and a cap is secured in said channel thereby concealing fastening means extending through said post.

* * * * *